US007494446B2

(12) United States Patent
Weck et al.

(10) Patent No.: US 7,494,446 B2
(45) **Date of Patent: *Feb. 24, 2009**

(54) BALANCING DEVICE

(75) Inventors: David Weck, San Diego, CA (US); James E. Cotter, Ashland, OH (US)

(73) Assignee: BOSU Fitness, LLC, San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/981,878

(22) Filed: Oct. 31, 2007

(65) Prior Publication Data

US 2008/0064579 A1 Mar. 13, 2008

Related U.S. Application Data

(60) Continuation of application No. 10/286,178, filed on Oct. 31, 2002, now Pat. No. 7,344,488, which is a division of application No. 09/687,896, filed on Oct. 13, 2000, now Pat. No. 6,554,753, which is a continuation-in-part of application No. 09/596,709, filed on Jun. 19, 2000, now Pat. No. 6,575,885, which is a continuation-in-part of application No. 09/411,997, filed on Oct. 4, 1999, now Pat. No. 6,422,983.

(51) Int. Cl.
*A63B 21/05* (2006.01)

(52) U.S. Cl. ..... 482/47; 482/77

(58) Field of Classification Search ..... 482/147, 482/146, 148, 121, 140, 77, 132; 5/655, 5/3

See application file for complete search history.

(56) References Cited

U.S. PATENT DOCUMENTS 1,545,437 A 7/1925 Malone et al.
1,755,205 A 4/1930 Christensen
2,077,233 A 4/1937 Greenhill
2,521,530 A 9/1950 McGuffage
2,991,589 A 7/1961 Ayala
3,024,021 A 3/1962 Coplin et al.
3,069,162 A 12/1962 Samuel
3,165,759 A 1/1965 O'Daniell
3,176,982 A 4/1965 O'Daniell
3,356,367 A 12/1967 Tewksbury
3,421,163 A 1/1969 Stoughton (Continued)

FOREIGN PATENT DOCUMENTS

DE 20 32 544 A1 1/1972

(Continued)

OTHER PUBLICATIONS

Jump Board: Digital Photographs showing a toy called a "jump board" made by Hedstrom Corporation, no date.

(Continued)

*Primary Examiner*—Jerome Donnelly
(74) *Attorney, Agent, or Firm*—Lerner, David, Littenberg, Krumholz & Mentlik, LLP

(57) ABSTRACT

A balancing device has a base and an inflatable flexible portion wherein the center of the inflatable portion is higher than the edges. The device is used by placing the base on the floor and standing and moving on the bladder.

12 Claims, 15 Drawing Sheets

U.S. PATENT DOCUMENTS

| | | | | |
|---|---|---|---|---|
| 3,604,726 | A | 9/1971 | Tracy | |
| 3,627,314 | A | 12/1971 | Brown | |
| 3,716,229 | A | 2/1973 | Van Der Cleyen et al. | |
| 4,065,124 | A | 12/1977 | Egan | |
| 4,067,078 | A | 1/1978 | Winston | |
| 4,126,129 | A | 11/1978 | Rainbow | |
| 4,159,826 | A | 7/1979 | Hancock | |
| 4,191,178 | A | 3/1980 | Wisnieski | |
| 4,263,682 | A | 4/1981 | Bejarano | |
| 4,516,767 | A | 5/1985 | Eskijian | |
| 4,516,768 | A | 5/1985 | Gallaro | |
| 4,801,140 | A | 1/1989 | Bergeron | |
| 4,867,451 | A | 9/1989 | Mitchell | |
| 4,893,809 | A | 1/1990 | Blankenzee | |
| 5,048,823 | A | 9/1991 | Bean | |
| 5,116,045 | A | 5/1992 | Jahoda | |
| 5,282,777 | A | 2/1994 | Myers | |
| 5,301,441 | A | 4/1994 | Kownacki | |
| 5,333,336 | A | 8/1994 | Langsam | |
| D361,604 | S | 8/1995 | Stroppiana | |
| 5,549,536 | A | 8/1996 | Clark | |
| 5,643,154 | A | 7/1997 | Awbrey et al. | |
| 5,643,165 | A | 7/1997 | Klekamp | |
| 5,690,389 | A | 11/1997 | Ekman et al. | |
| 5,728,031 | A | 3/1998 | Honeycutt | |
| 5,735,776 | A | 4/1998 | Swezey et al. | |
| 5,810,700 | A | 9/1998 | Orcutt | |
| 5,810,703 | A | 9/1998 | Stack et al. | |
| 5,833,587 | A | 11/1998 | Strong et al. | |
| 5,881,407 | A | 3/1999 | Chu Pt | |
| 6,012,188 | A | 1/2000 | Daniels et al. | |
| 6,070,943 | A | 6/2000 | Guery-Strahm | |
| 6,309,331 | B1 | 10/2001 | Raymond | |
| 6,422,983 | B1 | 7/2002 | Weck | |
| 6,461,285 | B1 | 10/2002 | Theunissen et al. | |
| 6,554,753 | B1 | 4/2003 | Weck et al. | |
| 6,575,885 | B1 | 6/2003 | Weck et al. | |
| 6,634,999 | B2 | 10/2003 | Herbst | |
| 6,702,726 | B2 | 3/2004 | Lin | |
| 7,344,488 | B2 * | 3/2008 | Weck et al. | 482/147 |
| 2003/0054927 | A1 | 3/2003 | Weck et al. | |

FOREIGN PATENT DOCUMENTS

| | | | |
|---|---|---|---|
| DE | 2528217 | | 6/1975 |
| DE | 31 50 189 | A1 | 7/1983 |
| DE | 36 20 706 | A1 | 12/1987 |
| EP | 0 134 047 | A1 | 3/1985 |
| GB | 2226769 | | 11/1990 |
| WO | WO-02/30519 | | 4/2002 |

OTHER PUBLICATIONS

Exercise Balls; Gymnic Line, etc., www.balldynamics.com, no date.
Dyna-Disc Pillow, etc., Perform Better, no date.
Disc'O'Sit Air Cushion, etc., www.balldynamics.com, no date.
Duradisk, etc., www.paulchecksemainars.com, no date.
Sit Fit, www.rpsportsinc.com/balance.htm, no date.
K.A.T. 2000, www.oimmedical.com (2 pg), no date.
Pogo Ball Drawing, no date.
K.A.T. 500 product sheet, no date.
Lower Extremity, Exercise Equipment (K.A.T. Products, no date.
K.A.T. 550 product description, no date.
Duradisk Wobble Board, etc. www.paulcheksminars.com, no date.
Letter dated Jun. 21, 1967 from Don Faurot (STFQ 02275).
Swiss Ball Exercises manuscript, taught by Beate Carriere (48 pages) (STFQ 02378-02428), no date.
Dialog abstract, DE2528217 (STFQ 02281), no date.
"Oscar O'Daniell Inventor of the Bubble Jumper", 4 pages, (STFQ 02268-02271), no date.
Letter dated Jan. 24, 1967 from Oscar O'Daniell (STFQ 02276).
Letter dated Dec. 15, 1966 from Oscar O'Daniell (STFQ 02277).
Products List Circular Aug. 1965 (STFQ 02278-02280).
Swiss Ball Exercises manuscript, by Dr. med. h.C. Susanne Klein-Vogelbach; Springer-Verlag Berlin Heidelberg New York 1981. ###Balance exercise appts. for spastics and practising physical jerks—comprises spherical base with circular support surface for user to balance on.###Circular Products List, prepared by The Office of Business Advisory Services, Jun. 30, 1965.###A pamplet on Bubble Jumper, West Side Radiator Shop.
Dialog search, 2003, Balance exercise appts. for spastics and practising physical jerks—comprises spherical base with circular support surface for user to balance on.
Swiss Ball Exercises manuscript, by Dr. med. h.c. Susanne Klein-Vogelbach, Springer-Vertag Berlin Heidelberg New York 1981 (48 pages) (STFQ 02378-02428).
Dialog search, 2003, Balance exercise appts. for spastics and practising physical jerks—comprises spherical base with circular support surface for user to balance on (STFQ 02281).
Letter dated Jun. 21, 1967 from Don Faurot, letter dated Jan. 24, 1967 from Oscar O'Daniell, letter dated Dec. 15, 1996 from Oscar O'Daniell, products list circular (no date) (STFQ 02280-02279).
Oscar O'Daniell Inventor of the Bubble Jumper, 5 pages, STFQ 02268-02271 (no date).
Letter dated Jan. 24, 1987 from Oscar O'Daniell.
Letter dated Dec. 15, 1966 from Oscar O'Daniell.
Products List Circular Aug. 1965 (STFQ 02275-02280).
My Early Years, http://www.genealogytoday.com/barrel/prestory.html, no date.
Fast Facts On: Developmental Disabilities, http://www.moddrc.com/Information-Disabilities/Fast/Facts/Sensory, no date, integration.htm.
Deep Stupid 2001 Oversized Croquet, http://deepstupid.com.
Inflatable Smiley Face Wobble Ball, http://www.joissu.com/prodinfo.asp?number=59-210, no date.
Wobbly Fun Ball, http://shopping.sify.com/shopping/product_detail.php?pid=12101&prodid=13951492, no date.
Swine, http://www.bio-serv.com/newcatalog/eeprod/swina/bestball.html, no date.
Wufer Ball Dog Toy, http://www.cleanrun.com/category.cfm?Category=49, no date.
Zap Ball Dog Toy, http://www.cleanrun.com/category.cfm?Category=49, no date.
Hedstrom, Active Play For Active Kids, Spring 2000 Toy Catalog.
Wild Trax Supply, http://www.wildtraxsupply.com/ecommerce/shop_now.cfm?category=toys, no date.
Sanctuary Supplies, http://www.sanctuarysupplies.com/toys.html, no date.
Canine Capers, The IndestructaBall, no date.
PetEdge, Push 'n Play Balls, no date.
Wobbly Fun Ball, hppt://shopping.sify.com/shopping/product_detail.php?pid=12101&prodid=13951492, no date.
Duradisk Wobble Board, etc. www.paulchekseminars.com, no date.

* cited by examiner

BALANCING DEVICE

CROSS-REFERENCE TO RELATED APPLICATIONS

The present application is a continuation of U.S. patent application Ser. No. 10/286,178, filed Oct. 31, 2002, which is a divisional of U.S. patent application Ser. No. 09/687,896, filed Oct. 13, 2000, which application is a continuation-in-part of and claims the benefit of U.S. patent application Ser. Nos 09/596,709, filed Jun. 19, 2000, and 09/411,997, filed Oct. 4, 1999. The disclosures of the foregoing applications are hereby incorporated by reference herein.

BACKGROUND OF THE INVENTION

Many devices are known for facilitating exercises done for therapy, conditioning or physical training. Other than variable resistance training equipment, these devices have not usually offered much adjustability to allow for exercises at different degrees of difficulty. Also, many of these devices have been dedicated to very specific exercises and therefore do not justify a significant investment of space and financial resources for such a narrow purpose.

Some exercise devices require a person to maintain balance and equilibrium. A large inflatable ball (for example, 65 cm) known as a Swiss ball, has been used for this purpose. While the ball is useful for certain stability training exercises, standing upon the ball or staying atop the ball requires a high degree of skill and is inappropriate for most.

In U.S. Pat. No. 4,801,140 a person suffering from a physical disability can stand on the flat side of a non-inflatable molded foam hemisphere to practice balancing. The practical disadvantage of this design is that a high degree of skill is required before someone can actually stand on such an unstable platform. Without assistance from a therapist or additional balancing accessories, this platform is accessible only to trained athletes.

In U.S. Pat. No. 5,810,703 the underside of a small board is fitted with a smaller spherical projection. The relatively small diameter of the spherical projection tends to make the board relatively unstable. The height of the spherical projection can be set to one of three discrete settings. Overall, the adjustment has little range and resolution. Also, the projection, if inverted to face upwardly, is too small to allow a person to perform an exercise while placing weight on the projection.

An inflated cushion in the shape of a disk (sold under the name DuraDisk through C.H.E.K. Institute) has been described as useful for certain exercises. This cushion is described as needing no inflation, but the product is shipped with an inflation valve that the user has access to. A separate wooden platform, 20 inches in diameter, is sold for the purpose of placing the platform over the cushion to create a balance board. This cushion is relatively flat and therefore offers little challenge to a user. It is not useful for the inflatable disk to be placed on the board as this would offer no advantage over putting the inflatable disk on the floor. Also, the use of a separate platform requires careful placement and centering of the platform and also introduces the need for regularly finding and associating the separate parts.

In U.S. Pat. No. 5,643,154, a relatively squat, rounded ballast is mounted under a relatively wide platform. If the user is willing to stock an inventory, the rounded ballast can be changed, but the individual ballasts are not adjustable. This device is designed for use on land or in water. For use in water, an edge bumper is inflated an adjustable amount to reach the desired buoyance. While this edge bumper is adjustable, this adjustment is only effective in water. The stability of the platform on land will not be substantially affected by adjusting an edge bumper, which inherently provides a stable base. See also U.S. Pat. No. 3,024,021 for a non-adjustable device employing a platform connected through a resilient member to a rounded base.

U.S. Pat. No. 5,643,165 shows a frustroconical balancing device with a flattened apex. This device is stable in only one central position, and becomes highly unstable once titled slightly. Furthermore, the stability of this device is not adjustable. See also U.S. Pat. No. 5,549,536 for a continually tilted platform.

Accordingly, there is a need for an improved device that offers a unique experience and range of possible exercises, and that can allow adjustment, preferably with an inflatable device, to accommodate persons with different levels of skill and capabilities.

SUMMARY OF THE INVENTION

The invention is directed to those needs.

One embodiment of the invention is a device for promoting balance. The device has a base to keep the device in contact with a planar surface, such as a floor. The device also has an inflatable flexible portion positioned on top of the base. The flexible portion is structured and arranged such that if it is compressed at a point adjacent but not at the center, the flexible portion exerts a force having a component away from the center of the flexible portion which tends to cause the person to be displaced unless the person exercised sufficient balance to resist the outside force.

Preferably, the inflatable portion is a bladder wherein at certain gas pressures within the chamber of the bladder, the top of the bladder is convex with respect to, and generally circular when viewed from, a point above the device. The volume of the chamber is proportional to the gas pressure.

It is also preferable for the bladder to be anchored to the base at points radially distant from the longitudinal axis of device (where the bladder defines a longitudinal axis generally transverse to the planer surface). The anchored points may be below the center of the top of the bladder. Moreover, for the majority of points along the top of the bladder between the center and the anchored points, as the radial distance from longitudinal axis increases so does the axial distance from the top center point of the bladder.

Another embodiment of the invention also provides a device for promoting balance. In this embodiment, the device has an inflatable flexible bladder defining a longitudinal axis extending through the center of the bladder. The upper and lower surface of the bladder define a chamber and meet at the outer edges. The upper surface of the bladder is structured and arranged so that the highest point of the bladder is at a point between the outer edges, and a user standing on the device has to exercise balance to remain on it. The bladder is also connected to a base at the outer edges.

It is desirable for the device to be generally circular about the longitudinal axis and the base generally cylindrical. It is also desirable for the base to be concave along the longitudinal axis when viewed from a point below the base, and to maintain at least three points of contact with a generally planer surface such as a floor. When the bladder is inflated, the expansion of the bladder causes the center of the base to move towards, but not contact, the planar surface. The lower surface may be generally planer prior to inflation.

Preferably, the device has a plurality of generally annular ridges disposed on the upper surface of the bladder that circumferentially extend around the longitudinal axis. The diameter of the generally annular ridges may be proportional to the gas pressure within the inflatable bladder.

It is also preferable for the bladder to have a hole extending through the bottom surface and connecting the chamber to atmosphere. A removable plug is used to close the bladder hole. In such an instance, the base also has a hole extending from the bottom of the base to the top of the base, the base hole being adjacent to the bladder hole. Preferably, the portion of the bottom surface of the bladder that is adjacent to the bladder hole has a truncated cone shape that extends downwardly into the base hole.

In yet another embodiment of the device, a device for promoting balance has a longitudinal axis and includes: an inflatable bladder having top and bottom surfaces that define a chamber and are joined at edges positioned a radial distance from the longitudinal axis; a rigid base having a top surface, bottom surface and outer edges, the bottom surface intended for placement on a planar surface, and the top surface of the rigid base opposing the bottom surface of the bladder; a clamp circumferentially extending around at least a portion of the base; and a groove defined by the clamp and the base to secure the bladder edges to the base.

Desirably, the outer edges of the bladder define a generally planer circle extending circumferentially around the longitudinal axis.

Optionally, the outer edges comprise a rim meeting one or more of the following conditions: a portion of the rim is below at least a portion of the bottom surface of the bladder; the outermost point of the rim is beyond the outermost point of the bladder top surface; the bottom surface and the top surface of the bladder meet at a point near the top of the rim and the radial width of the bottom edge of the rim is greater than the radial width at that point; the width at the top of the groove is less than width of the rim and the rim is disposed in the groove; the rim has a flange extending upwardly from the top, outer edge of the rim; the rim has a flange extending inwardly from the bottom half of the inner edge of the rim; and the rim has a rim chamber in communication with the chamber of the bladder whereby increasing the pressure within the rim chamber increases the size of the rim.

It is preferable for the clamp to have a side and a top extending inwardly from the side, so that the groove is at least partially defined by the side of the clamp and a portion of the base. Thus, the groove may further have a bottom and an inner side that are defined by the base. A portion of the base may also extend from the inner side and outwardly over the groove and the top of the clamp may extend inwardly over the groove.

In a further refinement of the foregoing embodiment, the outer edges comprise a rim, the rim comprises a first flange extending upwardly from the top outer edge of the rim and below the portion of the clamp extending inwardly over the groove, and the rim comprises a second flange extending inwardly from the bottom half of the inner edge of the rim and below the portion of the base extending outwardly over the groove.

It is desirable for the dimensions of the groove to be sufficient to secure the bladder edges to the base wherein if the clamp is removed from the base, the bladder will not remain secured to the base during use.

The clamp may also include a number of optional features. For example, it may have a rounded ridge extending upwardly from the top, inner-most edge of the clamp. It may also be made of polypropylene, no-break polypropylene or high-density polyethylene. The clamp may also comprise a plurality of separate clamp portions whereby each portion extends less than the entire circumference of the base. Even so, all of the clamp portions collectively may extend around the entire circumference of the base. The clamp portions may be removably affixed to one another by a screw or similar fastener. The clamp portions may also be removably affixed to one another by use of a lap joint. The radial thickness of the clamp may be greater at the lap joint than at the remainder of the clamp, such that the thickness of a clamp portion at the lap joint is approximately equivalent to the thickness of the remainder of the clamp portion.

A further embodiment of the present invention provides a method of manufacturing a device for promoting balance. The steps include: placing an inflatable flexible bladder on a base; placing a first clamp along the outer edges of a circumferential portion of the base in an abutting relationship with a portion of the outer edges of the inflatable bladder; placing a second clamp along the outer edges of another circumferential portion of the base in an abutting relationship with another portion of the outer edges of the inflatable bladder; securing the first clamp to the second clamp and thusly securing the outer edges of the bladder into a circumferential groove defined by the clamps and the base.

In the foregoing method, the first clamp may be removably secured to the second clamp and the method further includes: detaching the first clamp from the second clamp; replacing the bladder with another bladder; and securing the first clamp to the second clamp and thusly securing the outer edges of the other bladder. Preferably, the first clamp and the second clamp collectively extend around a majority, or the entire length, of the outer edges of the base. The clamps may be placed along the outer edges of the base primarily by movement in a direction transverse to the longitudinal axis of the device.

In still another embodiment of the present invention, a method of using a device for promoting balance comprises: providing a device having an inflatable flexible bladder and a base, whereby the center of the top of the inflatable bladder is higher than the remainder of the inflatable bladder and the bladder is above and secured to the base; placing the bottom of the base on a planar surface such that the center of the top of the inflatable bladder is above the base and the planar surface; and standing or moving on the top of the inflatable bladder. Balance is promoted when the bladder tends to direct the user in a direction away from the center of the bladder. By way of example, the step of standing or moving on the top of the bladder may comprise repeated jumping on bladder.

The foregoing device can be made from a variety of materials. For instance, the bladder may be a burst-resistant vinyl, PVC or an elastomeric resin. The hardness of the bladder can reflect the intended use of the device. The bladder may also use a foaming agent.

Preferably, the upper and lower surfaces of the bladder are formed of a single, integral material by the process of rotational molding. It is also desirable for the bladder material thickness to be thicker at the center of the upper surface when uninflated than at the edges. The material thickness at the rim may also be greater than the average material thickness of the bladder.

DETAILED DESCRIPTION

Figure 1:
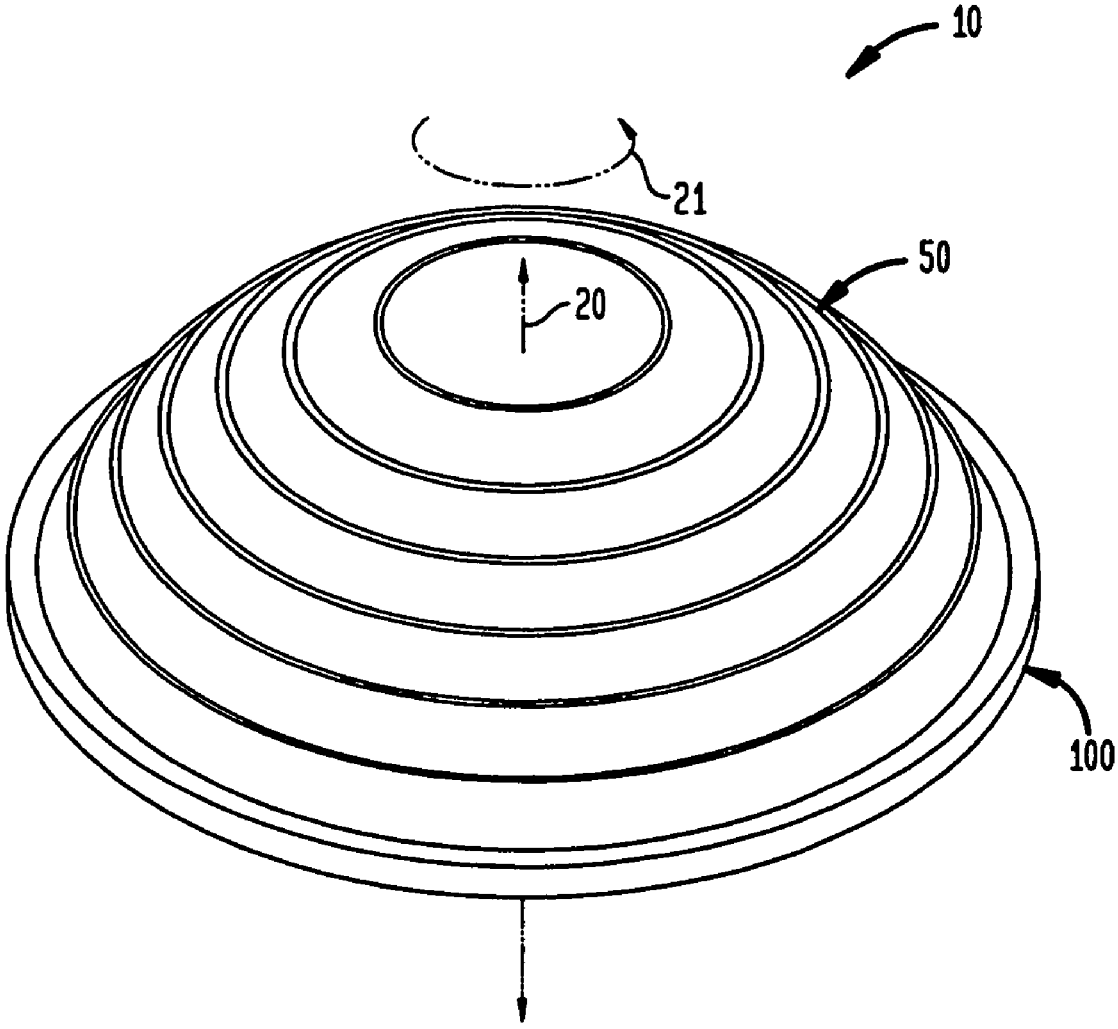
FIG. 1 is a perspective view of a device in accordance with the invention.

FIG. 1 illustrates one embodiment of a device 10 for promoting balance in individuals. Device 10 includes an inflatable portion 50 and a base 100.

Figure 3:
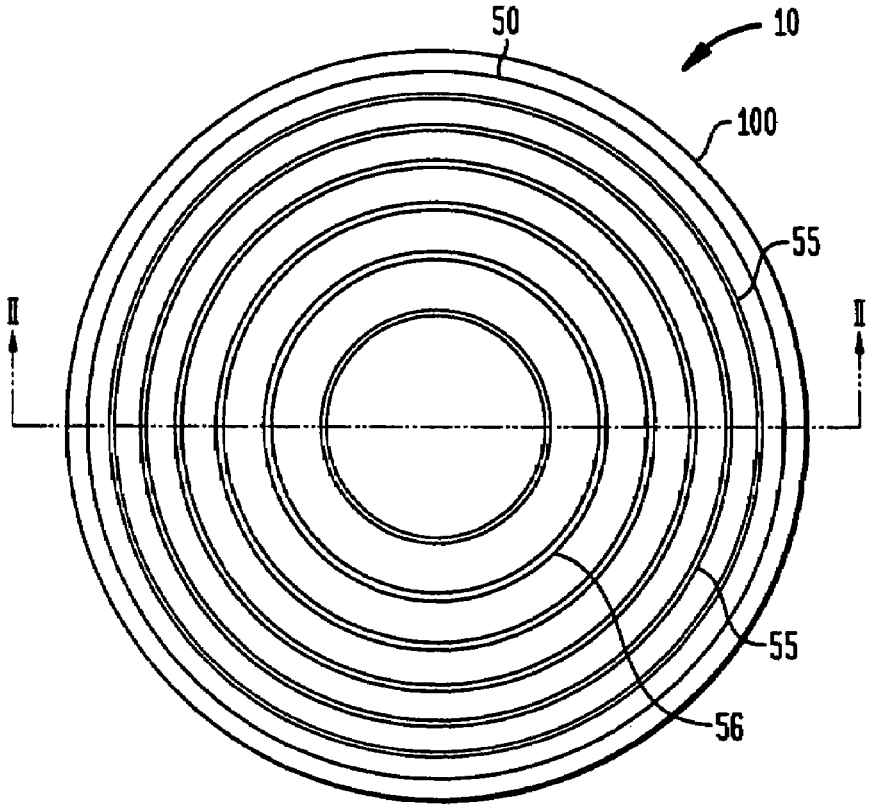
FIG. 3 is a plan view of the device.

Preferably, the device is generally hemispherical about a longitudinal axis 20 as shown in FIG. 1. Directions are stated in this disclosure with reference to the longitudinal axis 20. Thus, the terms "axial" and "axially" should be understood as referring to the directions parallel to longitudinal axis 20. "Upward" and "above" refer to one axial direction and "downward" and "below" refer to the opposite axial direction, such that the "top" portion of a component is spaced above a "bottom" portion. The terms "radial" and "radially" should be understood as referring to the directions transverse to this axis. The term inward" refers to radial directions towards the axis, whereas "outwardly" refers to radial directions away from the axis. "Circumferential" directions refer to directions around the longitudinal axis such as the direction indicated by arrow 21. As seen most readily in FIG. 3, the device is generally circular when viewed from above.

Although it should be understood that the actual dimensions of the device's components are not essential to the invention, certain dimensions are provided for illustrative purposes. For example, the device is particularly suited for use by a single adult when the radial distance from longitudinal axis 20 to the outer edge of bladder top 50 is about 16" and 30". However, the dimensions could increase or decrease depending on the intended uses. Other references to dimensions herein shall be made on the assumption that the device is about 24" wide.

The inflatable portion may be formed out of a bladder 50. Such a bladder is shown in more detail and in an inflated state in FIG. 2 (the other components of device 10 have been omitted from the figure to facilitate understanding). When inflated, the top 60 of bladder 50 is generally hemispherical or bowl-shaped such that radial center 51 of bladder top 60 is disposed above the bladder top's outer edges 52. In other words, the upper surface of inflatable portion 50 is generally concave with respect to the base such that the radial distance from longitudinal axis 20 to the upper surface of the bladder increases as the axial distance from center 51 (e.g., the point where the top of the bladder meets longitudinal axis 20) increases downwardly.

A number of annular ridges 55 are disposed on top of bladder top 50. The annular ridges extend in the circumferential direction and are radially spaced from one another such that they form concentric circles around the top of the device. The ridges should be large enough to aid the grip of a person standing or moving on the bladder (hereafter, a "user"). On the other hand, the ridges should not be so large that they are uncomfortable to the user. The ridges may be about 0.030" high and spaced about 1.4" apart from one another when the bladder partially inflated, which results in about 8 ridges being present on a 24" wide bladder.

While the top 60 of bladder 50 is generally hemispherical, the bottom 62 is generally planer. Bladder bottom 62 includes a hole 63 that allows air to travel between the outside of the bladder and the chamber 65 defined by the top and bottom of the bladder. Hole 63 preferably resides along the longitudinal axis 20.

Surrounding the hole 63 is a raised portion 64. Raised portion 64 extends downwardly from bladder bottom 62 and away from chamber 65. The radial width of the raised portion 64 varies such that the raised portion is widest immediately adjacent the bladder bottom 62 and is most narrow at the axial distance furthest from the bottom 62. In other words, the radial distance decreases as the raised portion 64 extends further away from the bladder bottom 62. Preferably, even the most narrow portion of the raised portion 64 has a radial distance greater than the radius of hole 63. Thus, the raised portion 64 has a hollow-truncated cone shape with the base of the cone connected to bladder bottom 62.

The axial distance from the bladder bottom 62 to the bottom of the raised portion may be about 0.4". At its widest, the raised portion may be about 1" and at its most narrow may be about 0.75". The diameter of the hole may be about 0.25".

Because of the elastomeric nature of bladder 50, the volume of inner chamber 65 is proportional to the amount of air pressure within the chamber.

Figure 2:
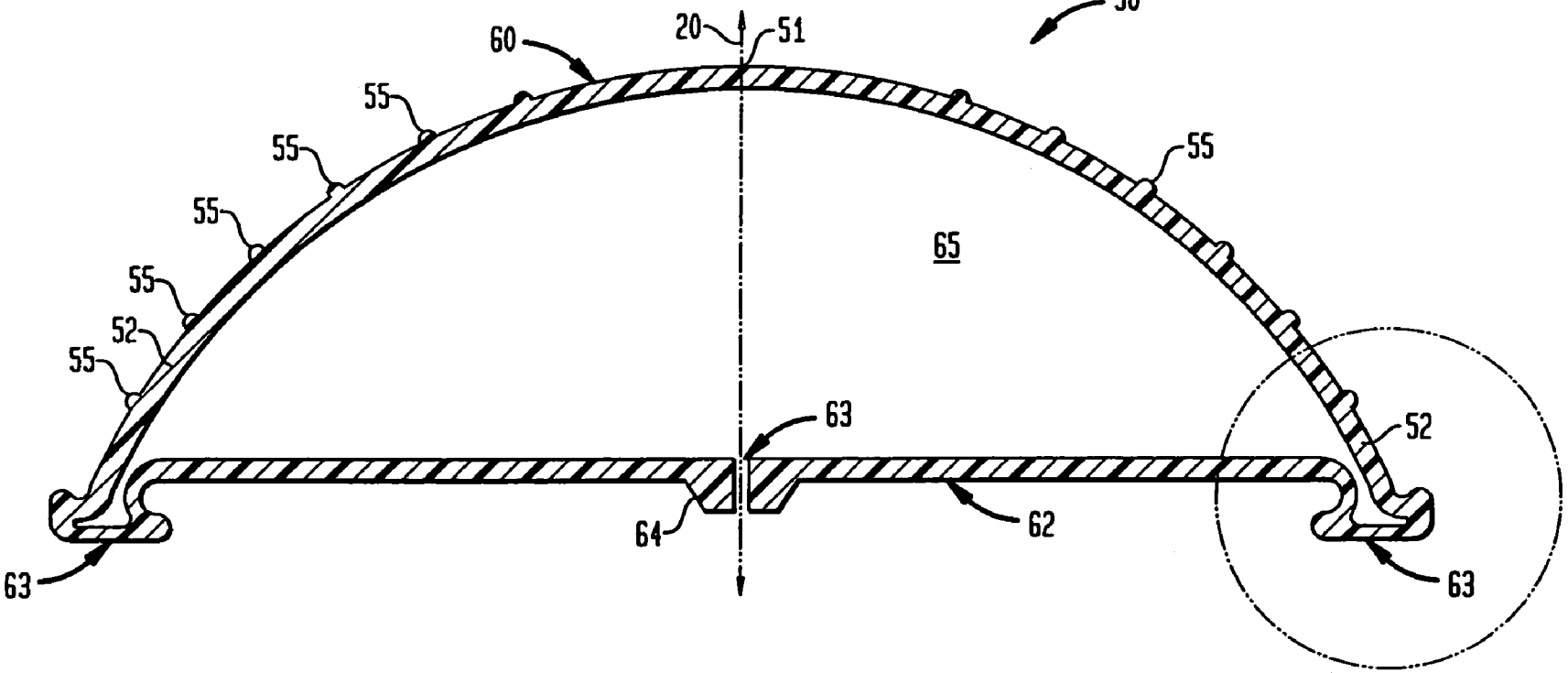
FIG. 2 is a cross-sectional view, with a dot-dash circle, of the inflatable portion of the device along line II-II of FIG. 3.

As shown in FIG. 2, the bottom 62 of bladder 50 meets the top 60 at the outer edges of the bladder. The top and bottom meet at both a constant radial and axial distance, such that the top and bottom meet at an edge which forms a planer circle extending circumferentially around the longitudinal axis 20.

Figure 4:
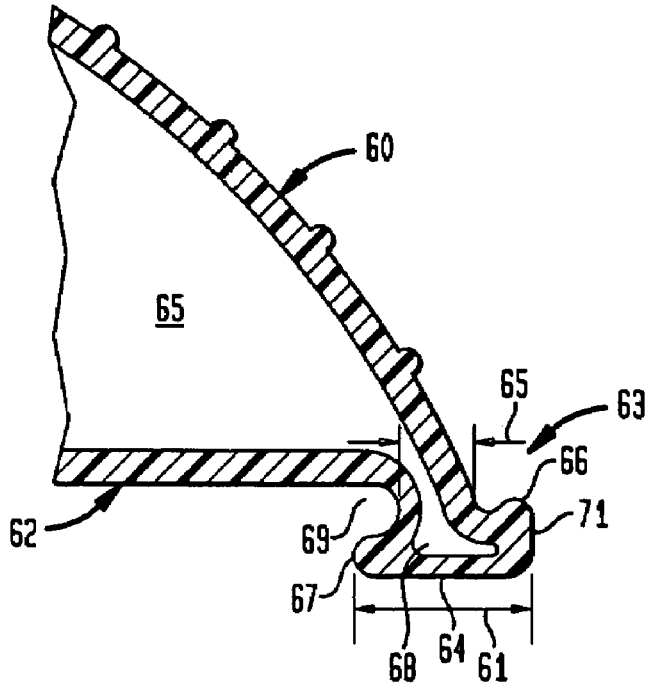
FIG. 4 is an enlarged view of the dot-dash circle of FIG. 2.

As shown in more detail in FIG. 4, rim 63 connects the top 60 to the bottom 62. The rim extends circumferentially around the outer edges of top 60 and is further disposed axially below bladder bottom 62. The outer edge 71 of rim 63 radially extends beyond the outer edge of bladder top 60. The bottom edge 64 of rim 63 is generally flat. The radial width 61 of bottom edge 64 is also wider than the point (indicated at dimension 65) where the rim 63 meets top 60 and bottom 62. This change in widths helps secure the bladder to the base as discussed in more detail below.

Rim 63 also includes two flanges. Specifically, top rim flange 66 extends upwardly from the top outer edge of rim 63. Bottom rim flange 67 extends inwardly from the bottom half of the inner edge of rim 63. The flanges also extend circumferentially around the longitudinal axis 20, and so may also be considered to comprise rings extending upwardly and inwardly from rim 63. As described in more detail in connection with FIG. 6, the rim flanges 66 and 67 are helpful in keeping the bladder 50 secured to the base.

A chamber 68 may be formed in rim 63. The rim chamber 68 is in communication with bladder chamber 65. Under the pressure of inflation, this chamber may expand rim 63 to further help the bladder stay in place.

The radial width 61 of bottom edge 64 may be about 1" and the radial width at dimension 65 may be about 0.25". The top rim flange 66 may extend about 0.095" above rim 63 and bottom rim flange 67 may extend about 0.275" inwardly from the rim. The axial distance of gap 69 between bottom rim flange 67 and bladder bottom 62 may be about 0.56". The distance from the bottom edge 64 to the top of top rim flange 66 may be about 0.5".

Preferably, the bladder is made out of a burst-resistant vinyl such as PVC or another plastisol or elastomeric resin. The hardness of the bladder material should reflect the intended use of the device 10. For example, if device 10 is primarily intended for outside use, a harder and more durable resin may be desirable. Heavier athletes may also need a more durable material. On the other hand, if the device is intended for inside use, a softer and more flexible resin may also be appropriate. A foaming agent may also be added to the material. Sand or the like may also be incorporated into the material to prevent slippage.

It is also desirable for the entire bladder to be formed from a single, integral material. The bladder may be formed by the process of rotational molding. Preferably, the mold is kept hotter at top center 51 (FIG. 2) to draw more material to that area and thus increase the thickness. Because the top center 51 tends to stretch more than the rest of the bladder when inflated, the extra material reinforces this section of the bladder. Similarly, the outer edges are also kept hotter to draw more material to the rim. The average thickness of the bladder material may be about 0.1".

Although the bladder bottom 62 is shown in FIG. 2 as being generally flat, the bottom 62 will also tend to expand during inflation. As explained in more detail below, the expansion of the bottom during inflation is constrained by base 100.

Figure 5:
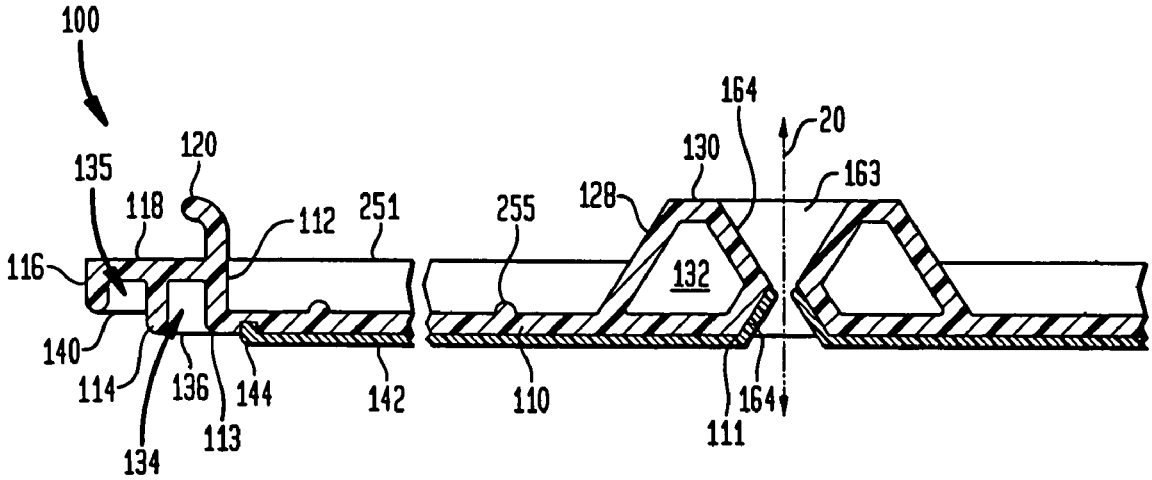
FIG. 5 is a partial cross-sectional view of the base taken along line II-II of FIG. 3.

The base 100 is generally cylindrical. As shown in FIG. 5 (which omits other components of the device for clarity), the bottom 110 of the base 100 radially extends from an inner base point 111 near the longitudinal axis 20 to an outer base point 113. (The outer base point 113 preferably does not extend to the outermost edge of base 100.) The radial distance between outer base point 113 and longitudinal axis 20 may be about 10.5".

Figure 6:
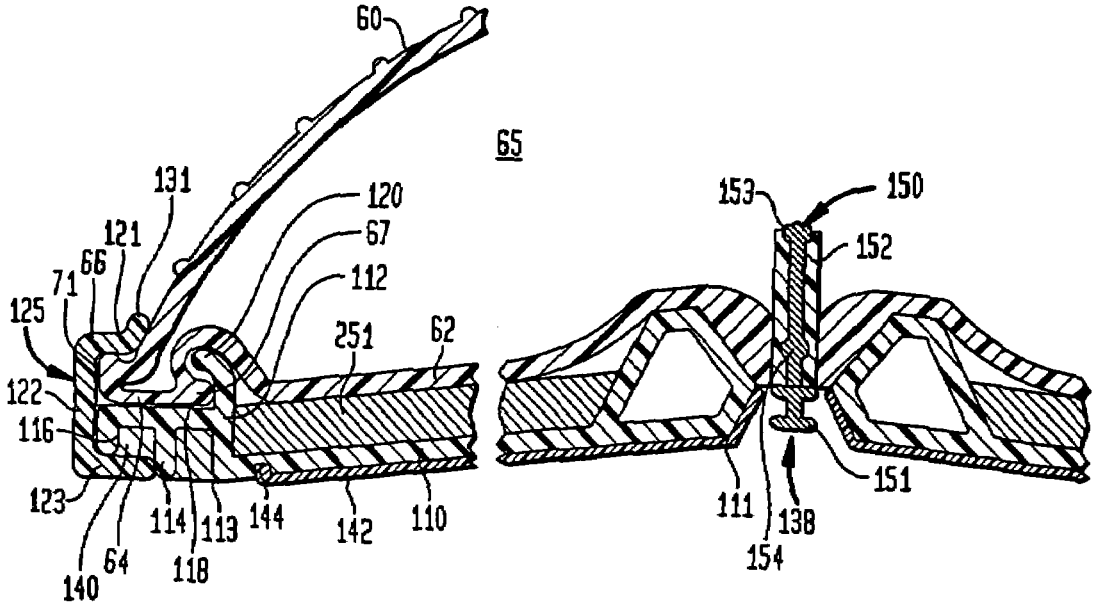
FIG. 6 is a partial cross-sectional view of a portion of the device taken along line II-II of FIG. 3.
Figure 7:
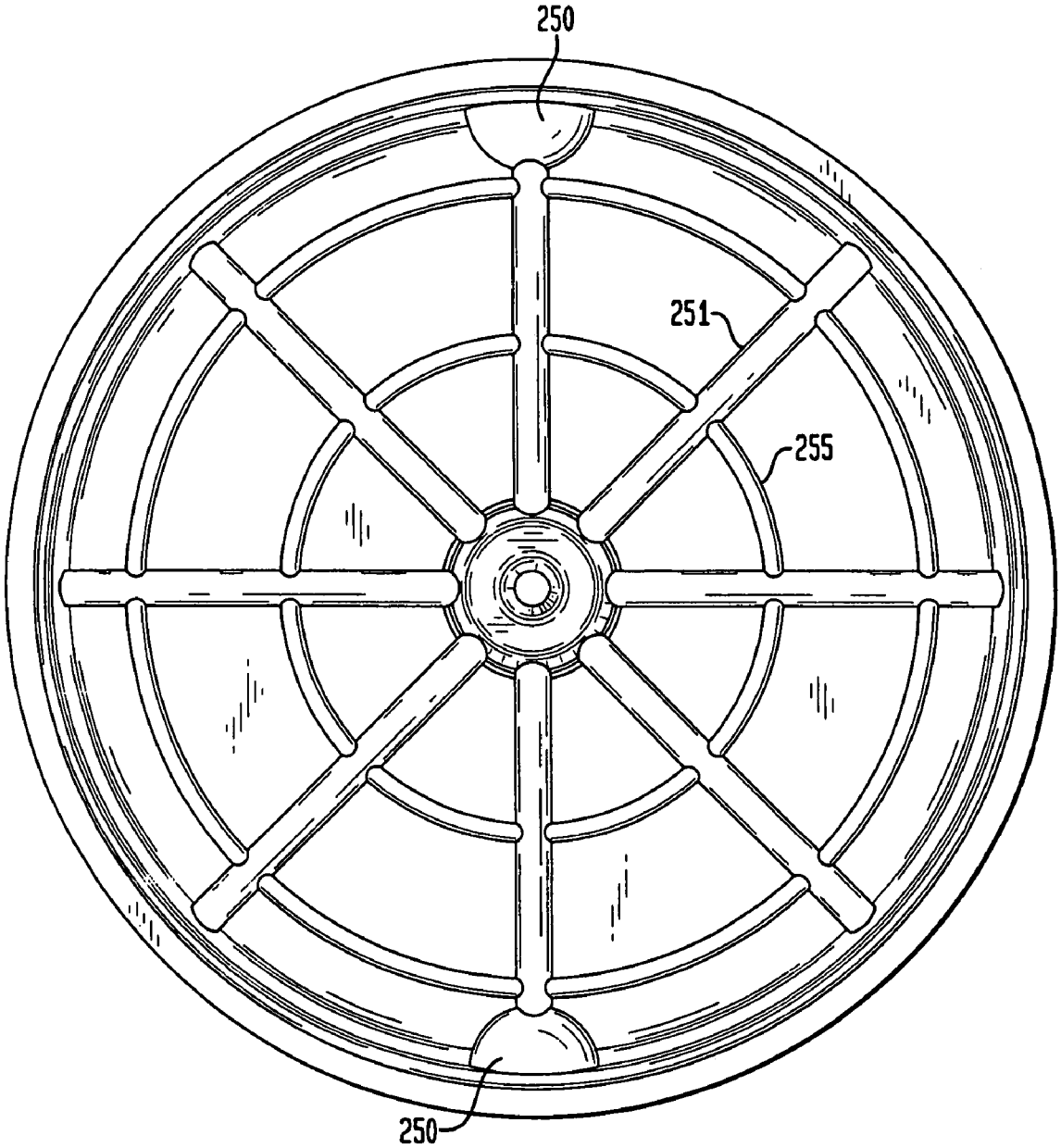
FIG. 7 is a plan view of the top of the base.

Preferably, although not shown in FIG. 5, bottom 110 of base 100 is not completely flat or planer. Rather, as shown in FIG. 6, the base is somewhat concave such that outer base point 113 is axially below the center of the base near longitudinal axis 20. Although the bottom of the base may be somewhat curved, the base 100 should maintain at least three points of contact with the floor for the purpose of stability. The axial distance between the outer base point 113 and the inner base point 111 may be about 0.5".

Returning to FIG. 5, inner wall 112 extends upwards from outer base point 113. A flange 120 is disposed at the top of inner wall 112 and extends a short distance radially outwardly from the top of the wall 112. Lip 118 also extends radially outwardly from inner wall 112. Lip 118 extends further out than flange 120 and is disposed at an axial distance below flange 120. Thus, flange 120 extends like a hook over lip 118. The axial height of inner wall 112 may be about 1.1". The radial width of flange 120 may be about 0.2". The radial width of lip 118 may be about 1".

Outer wall 116 extends down from the outermost edge of lip 118. In terms of axial distance, the lowest point of outer wall 116 is disposed above the lowest point of the base 100. Outer wall 116 defines the outermost point of base 100. The axial height of outer wall 116 may be about 0.25".

Middle wall 114 extends down from lip 118 at a radial point between outer wall 116 and inner wall 112. Middle wall 114 extends to a point which is at the same or slightly higher axial height along longitudinal axis 20 as outer base point 113. In other words, outer base point 113 is preferably lower than the bottom of middle wall 114. The axial height of middle wall 116 may be about 0.5".

At the center of the base, a hole 163 extends along the longitudinal axis 20 from the bottom of the base to the top. The hole is defined by hole wall 164. The radial distance of hole wall 164 from longitudinal axis 20 varies, such that the radial width is greater at the top and bottom of the hole than at the middle. A shelf 130 extends radially outwardly from the top of the hole 163, and from there wall 128 extends radially outwardly and axially downwardly to base bottom 110. Shelf 130, hole wall 164 and base bottom 110 define a chamber 132. At its widest, the hole 163 is about 1.5" wide and at its narrowest is about 1" wide. The hole may be about 1.1" high.

It should be understood that the structures discussed in connection with FIG. 5 also extend in the circumferential direction about the longitudinal axis 20. Thus, although outer base point 113 is described as a "point", outer base point 113 is actually a ring which circumferentially extends around the longitudinal axis 20. Likewise, chamber 132 is annular.

As shown in FIG. 5, a non-skid surface 142 is appended to the bottom 110 of base 100. The surface 142 is made of a somewhat sticky material such as thermoplastic rubber which helps the base 100 grip the floor surface while the device is in use. The non-skid surface 142 is appended to base 100 using the process of over-molding. A thin channel 144 is placed inward of and near outer base point 113 to help keep the non-skid surface from peeling off of the base bottom 110. The non-skid surface is preferably about 0.06" thick and channel 144 is preferably about 0.025" deep.

Figure 8:
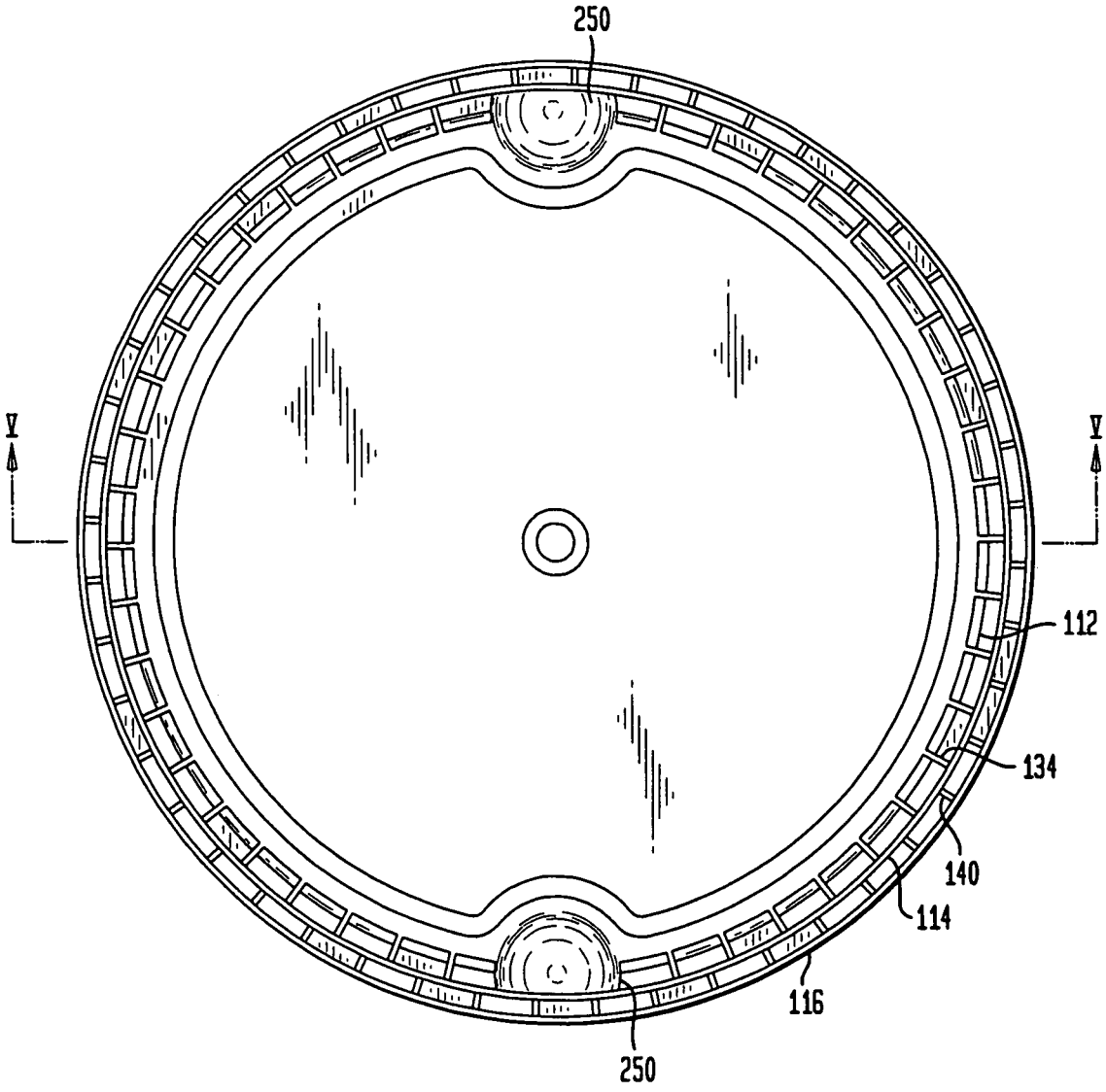
FIG. 8 is a plan view of the bottom of the base.

A variety of ribs connect the various walls. As more readily seen in FIG. 8, ribs 140 radially extend from middle wall 114 to outer wall 116 and ribs 134 radially extend from inner wall 112 to middle wall 114. The ribs are circumferentially spaced from one another. The ribs may be separated from one another by a distance of about 1.5".

In order to make the base more rigid, base 100 also includes a number of channels 251 and rings 255. As most readily seen in FIGS. 5 and 9, channels 251 radially extend across the top of base bottom 110 from inner wall 112 to wall 128. The channels are circumferentially spaced from one another in a pattern similar to spokes on a wheel. Because the channels are preferably formed using a gas assist process, the channels are hollow. The channels may be about 0.5" high.

Figure 9:
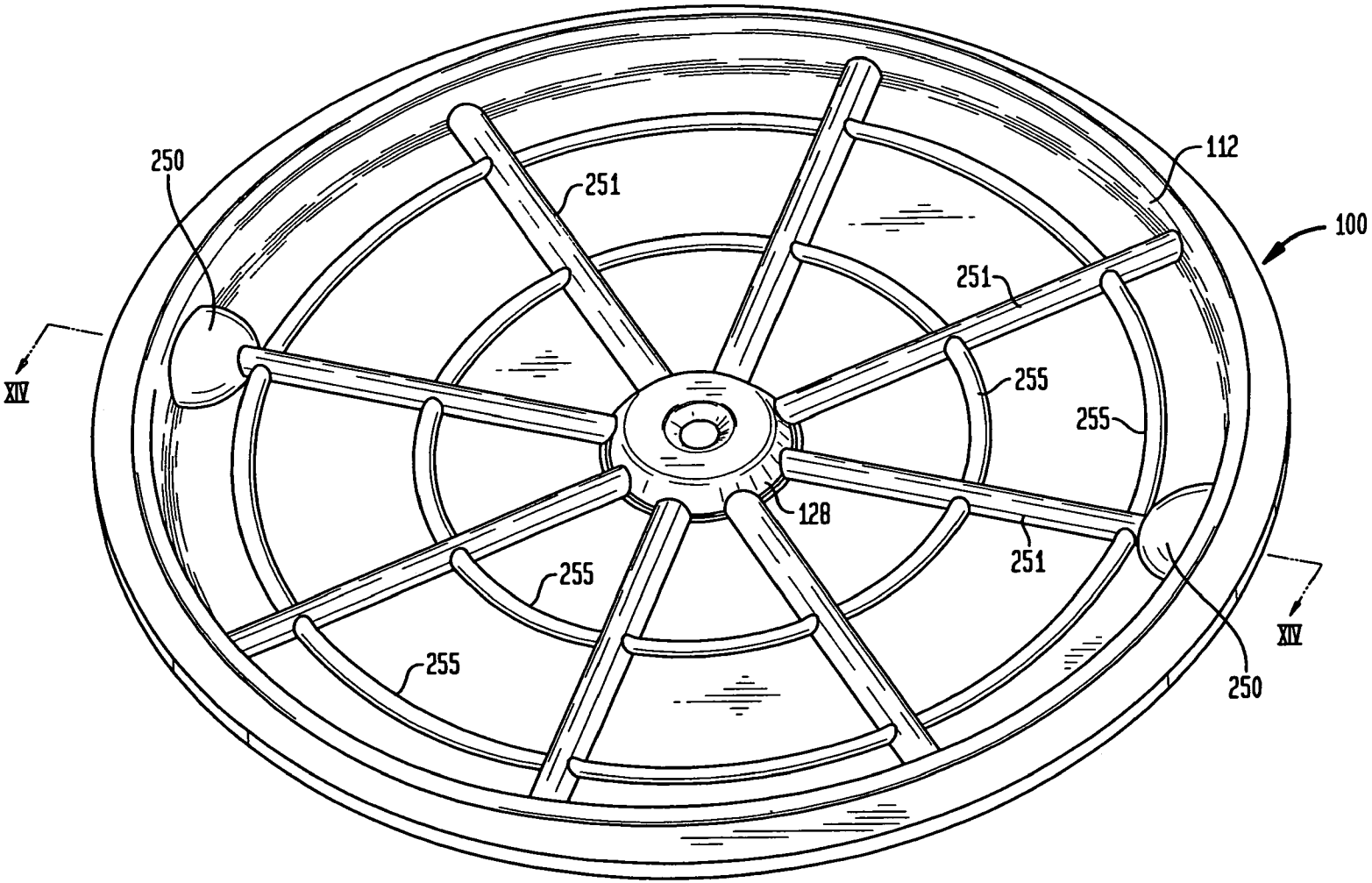
FIG. 9 is a perspective view of the top of the base.

Rings 255 are also disposed on top of base bottom 110. Rings 255 extend in the circumferential direction and are radially spaced from one another in a pattern similar to concentric circles. Although FIG. 9 shows eight channels and two rings, the number of channels and rings are variable. The rings, channels and ribs of base 100 add rigidity without undue weight.

Figure 10:
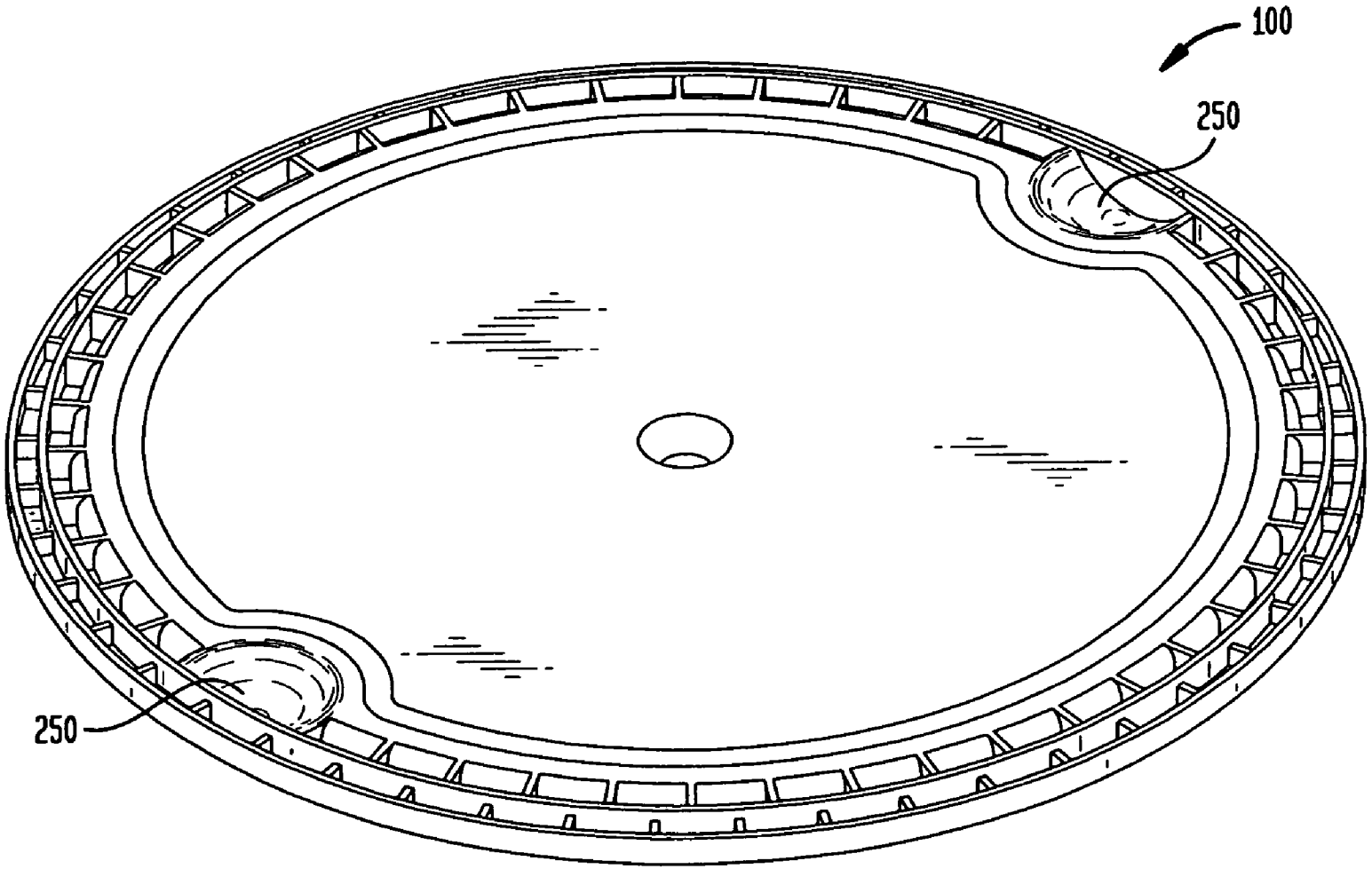
FIG. 10 is a perspective view of the bottom of the base.

As shown in FIGS. 9 and 10, base 100 also includes two handles 250. The handles are disposed on opposite sides of the base 100 and comprise concave indents which are accessible from the base bottom 110.

Figure 14:
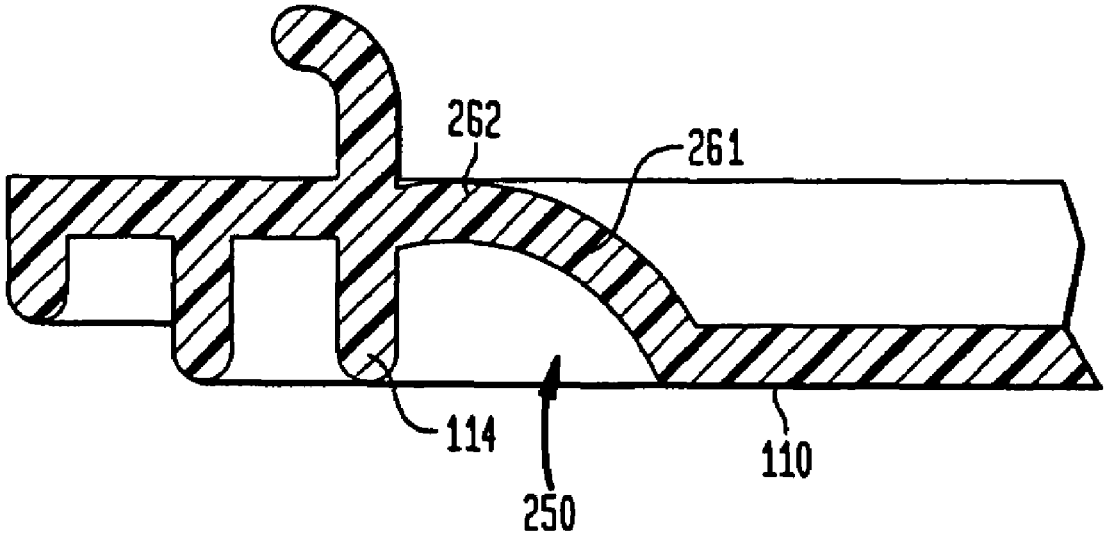
FIG. 14 is a partial cross-sectional view of the handle of the base taken along line XIV-XIV of FIG. 9.

As shown in more detail and in cross-section in FIG. 14, the indented handles are defined on one side by inner wall 114 and wall 261. Wall 261 forms an arc extending from a space near the top of the inner wall, upwards to a point 262 and then down to base bottom 110. The wall 261 is not only an arc in the radial direction, but also an arc in the circumferential direction as well. Thus, the handles have the shape of a portion of sphere. The holes should be large enough to let a person grip and move the device.

Although the base 100 may be formed of any material, such as wood, it is preferably made of a material such as PET, polypropylene, no-break polypropylene (polypropylene with added ethylene for extra resilience), filled polypropylene (the filler could be either glass or talc for extra rigidity) or PET. The various walls, flanges and the like of the base 100 may be about 0.15" thick. The platform may also be made of wood, in which case the platform would be solid and the ribs, rings and channels could be omitted.

FIG. 6 shows a portion of the assembled device in cross-section. During assembly, bladder 50 is placed on top of base 100 so that bottom 62 rests on channels 251 and opposes the top of the base. The hole in the bladder is further aligned with the hole in the base as shown by reference 138.

Rim 63 of bladder 50 is tucked under the flange 120. Specifically, the bottom rim flange 67 is tucked into the cavity created by flange 120, inner wall 112 and lip 118.

A C-shaped clamp 125 abuts base 100. As shown in FIG. 6, the clamp is C-shaped in the radial cross-section such that it has a top 121, side 122 and bottom 123. It also has an inner edge which faces base 100 and an outer edge which faces away from the base.

The inner edge of the clamp top 121 extends above top rim flange 66 of bladder 50. The presence of the flange helps hold the bladder in place. The inner edge of clamp side 122 faces outer edge 71 of bladder 50 and abuts outer wall 116 of base 100. The C-shaped clamp 125, lip 118 and flange 120 thus form a groove for holding the rib. The inner edge of clamp bottom 123 abuts the ribs 140 that extend between outer wall 116 and middle wall 114.

Upon assembly, the radial distance between clamp top 121 and flange 120 is roughly equal to the distance at dimension 65 (FIG. 2) of the bladder (the distance between the bladder top 60 and bottom 62). Thus, because rim bottom 64 is wider than this distance, the rim 63 and consequently the entire bladder 50 is firmly secure to the base once the clamp is in place (FIG. 6). Indeed, the bladder will remain in place even when completely deflated.

Preferably, a short, rounded ridge 131 extends upwardly from the top, innermost edge of the clamp 125. The ridge provides a number of advantages. First, because it is round, it eliminates sharp edges that might tear the bladder 50. Second, when the device is in use, the top 121 of clamp 125 is may receive some blows from the user. Thus, the extra material at ridge 131 also adds strength to the edge.

Clamp 125 is preferably made of polypropylene, no-break polypropylene or high-density polyethylene.

Figure 11:
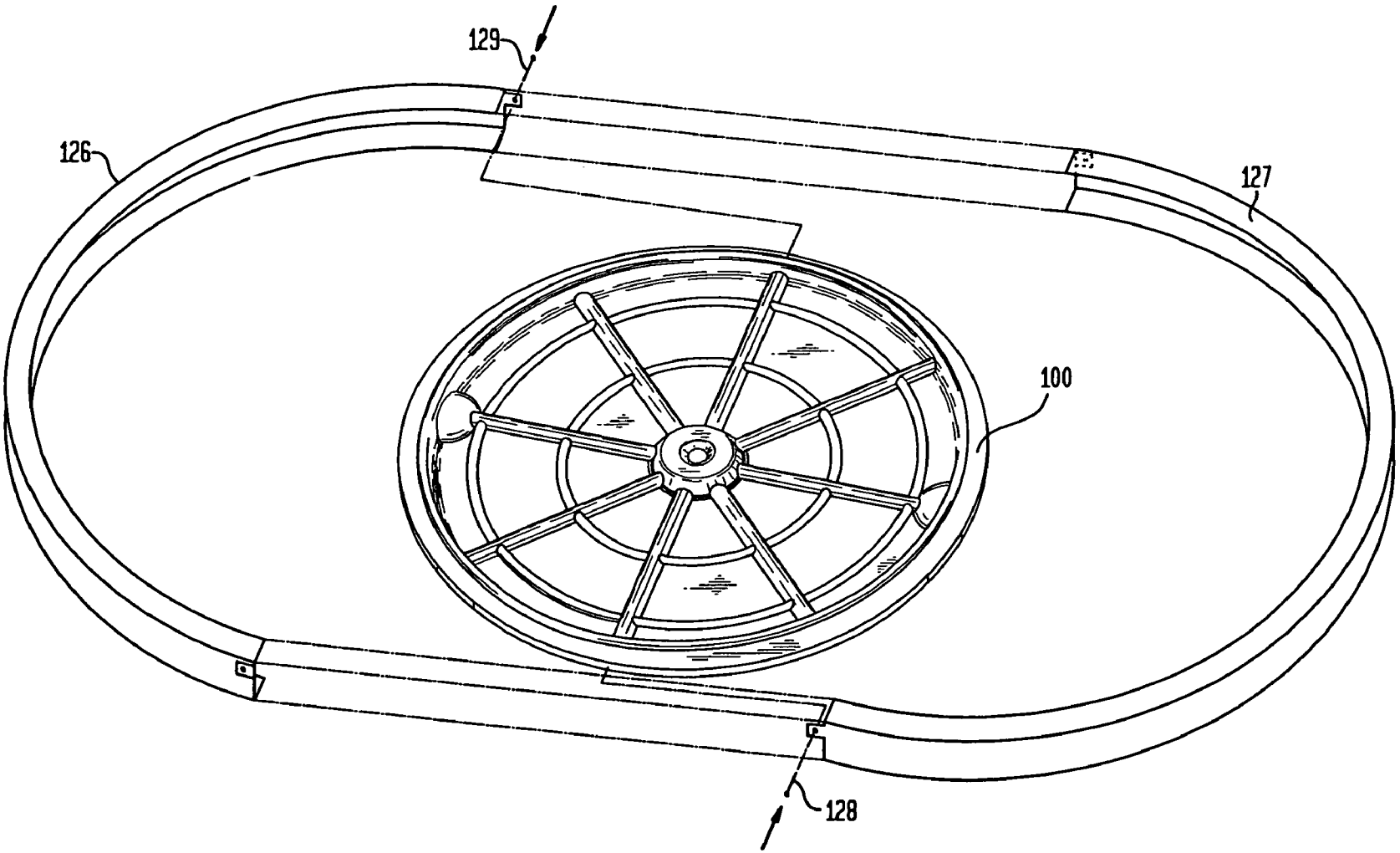
FIG. 11 is an exploded view of a manner of assembling the clamp halves to the base.

As shown in FIG. 11, the entire clamp 125 is made of two separate halves 126 and 127 that, together, extend circumferentially around the entire base 100. The separate pieces facilitate assembly. If the groove were already formed in the base 100 before assembly, it would be difficult to place the rim 63 into the groove due to the restricted width at the top of the groove. By placing the clamp halves on after the bladder and then connecting the halves together with screws 129, the groove is created after the bladder is in place.

Figure 12:
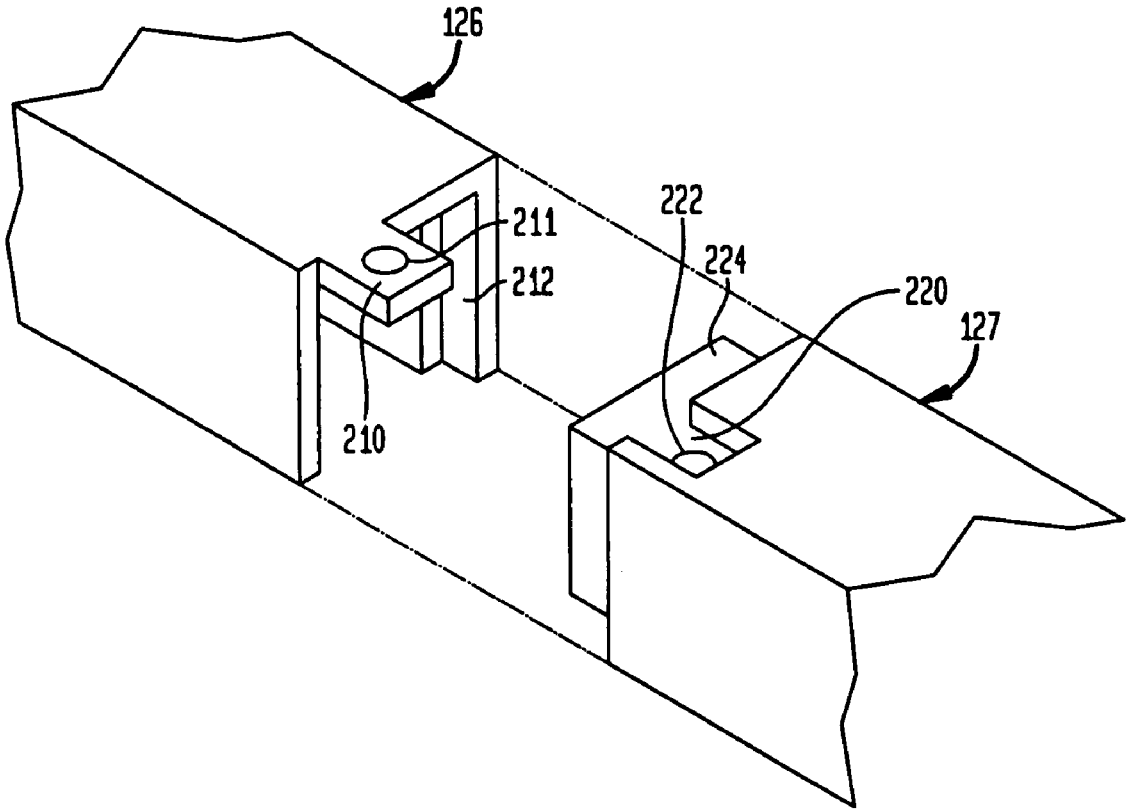
FIG. 12 is a perspective view of a portion of opposing ends of the clamp halves.

As shown in FIG. 12, the ends of the clamp halves are affixed to one another by use of a lap joint. Tongue 210 of clamp half 126 is placed in groove 220 of clamp half 127. Moreover, the outer portion 212 of clamp half 126 overlays the inner portion 224 of clamp half 127 to form a flush outer surface. The screw holes 211 and 222 of tongue 210 and groove 220, respectively, are also aligned so that a screw can be used to secure the clamp halves to one another. Preferably, the screw is counter-sinked so that the surface remains flush.

Figure 13:
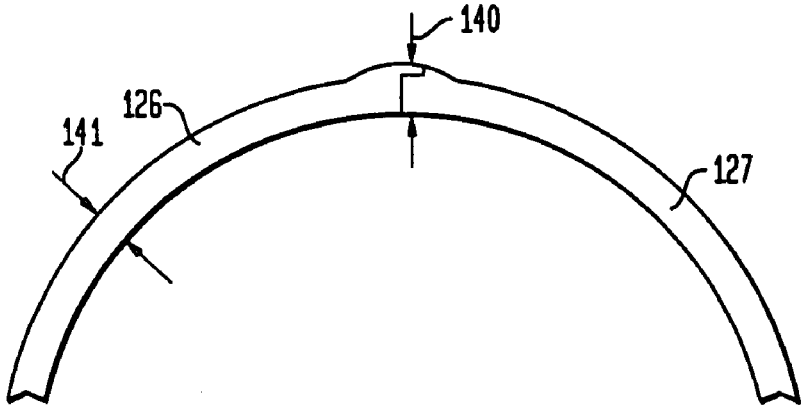
FIG. 13 is a top plan view of the end of two clamp joined halves.

As shown in FIG. 13, the radial width 140 at the lap joint may be greater than the radial width 141 of the rest of the clamp. This allows the tongue 210, outer portion 212 and inner portion 224 to maintain a thick width (otherwise, the width of the tongue and inner and outer portions 212 may be roughly of the thickness of the remainder of the clamp).

The structure of clamp 125 advantageously allows the bladder to be easily changed. The bladder can be replaced simply by removing two screws, sliding the clamps off, changing the bladder, sliding the clamps back on and reinserting the screws. As discussed above, the same base can be used with different bladders having different resilient properties, thus accommodating different exercise experiences. Therefore, rather than buying an entirely new device 10 for every purpose, the user may simply buy a single base and multiple bladders.

As shown in FIG. 6, a plug 150 is inserted in jacket 152 which is, in turn, inserted through the bladder hole. The plug and jacket form a hermetic seal, as does the jacket and the bladder. The plug 150 has bulges 153 and 154 for keeping the plug in the jacket 152. Plug 150 also has a handle 151. The plug should not extend too far into chamber 65 or else it may interfere with use of the device at low air pressures. The handle 151 should be also be sufficiently large to let the user get a good grip.

When fully assembled, the device preferably weighs between 8 and 16 pounds, and even more preferably weighs about 14 pounds. It is desirable that the unit be light enough to be transportable, but not so light that it moves from side to side when a person is active on it or jumping from one device to the other.

In operation, plug 150 is removed and bladder chamber 65 is filled with air via hole 163. The plug is then replaced to seal the air in the chamber.

Figure 15:
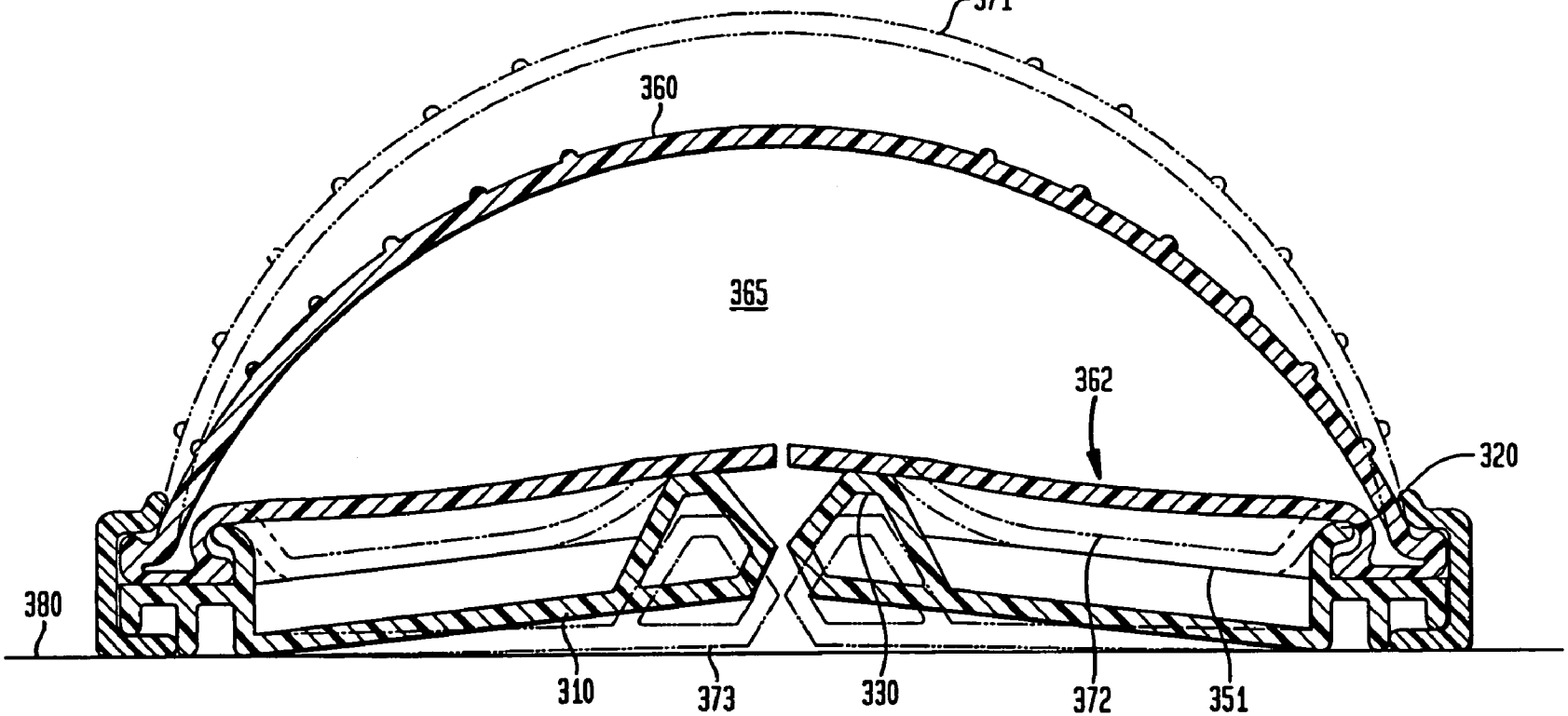
FIG. 15 is a cross-sectional view of the device 10 (with certain structure omitted for clarity) taken along line II-II of FIG. 3 and indicating a moved position.

The solid and dashed lines shown in FIG. 15 illustrate how the device responds to an increase of pressure in the bladder. When the bladder is partially inflated as shown by the solid lines in FIG. 15, the bladder bottom 362 essentially hangs between shelf 330 and flange 320 and may or may not touch the top of channel 351.

When fully inflated, the bladder expands due to the increased pressure. Because the bladder is anchored at the edges, the greatest change occurs at the radial center of the bladder. Thus, bladder top 360 bulges upward to position 371 and bladder bottom 362 will tend to bulge downward to position 372. As the bottom 362 bulges downward, it pushes forcefully on the channels 351 and particularly on shelf 330 which is at the center of the base. Accordingly, the center of the base will tend to be pushed downward into position 373.

The concave nature of the base bottom accommodates the increased pressure without loss of stability. In order to remain stable, the base 100 should maintain at least three points of contact with a planar surface such as floor 380; having only one or two points of contact may cause the base to wobble. The concave shape allows the base to retain the three points of contact. As the center of the base is pushed downward, it will expand into the gap between the base bottom 310 and floor 380 as shown in FIG. 15. Therefore, rather than resting on a bulging center, the device will continue to rest in a stable manner on the edges of the base.

A variety of exercises may be performed in connection with the device 10. For example, to promote balance, users may stand or jump on the bladder 50. Some of the possible exercises are discussed in detail in U.S. patent application Ser. No. 09/411,997, incorporated herein by reference, and therefore will not be repeated here.

Figure 17:
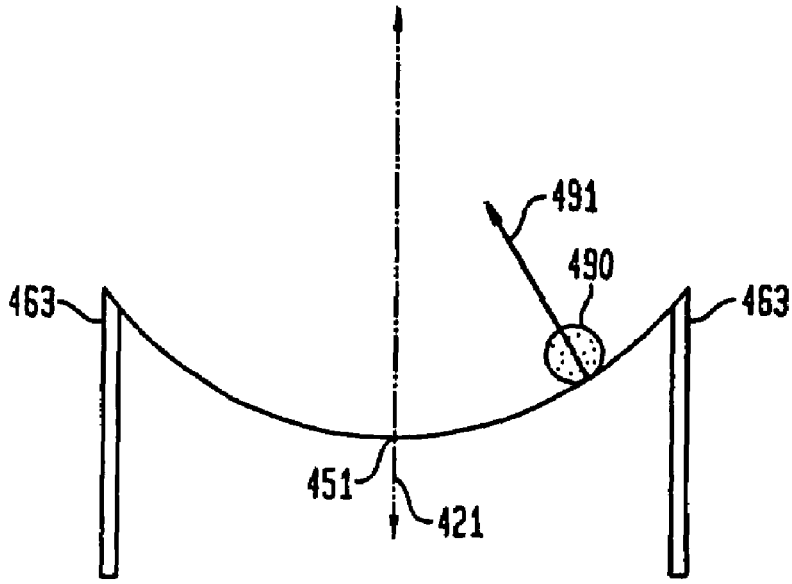
FIG. 17 (PRIOR ART)
FIG. 17 is a schematic diagram of the forces exerted on a load by a typical prior art trampoline.

Performing exercises on top of bladder 50 as base 100 rests on the floor provides numerous advantages. The convex shape of bladder 50 challenges users in a way that typical inflated or resilient devices cannot. For example, when a load 490 is dropped on a trampoline device as shown in FIG. 17, the concave shape of the resilient material exerts a reactive force on the load which pushes it towards the longitudinal axis 421 of the trampoline. In other words, because the resilient material is anchored at edges 463 which are above (or the same height as) center 451, the material exerts a force upon compression that tends to push the load towards the center of the device.

Figure 16:
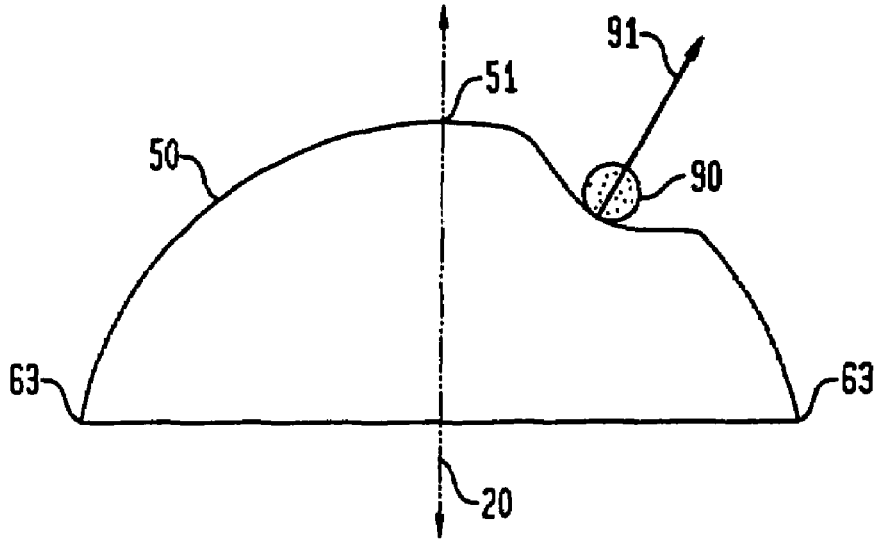
FIG. 16 is a schematic diagram of the forces exerted on a load by the device.

The present invention has the opposite property. As shown in FIG. 16, when load 90 is dropped on bladder 51, the convex shape of the resilient material exerts a reactive force on the load which pushes it away from the longitudinal axis 20. In other words, because the resilient material is anchored at edges 63 that are below center 51, the material exerts a force that tends to push the load away from the center and off of the device. (It should be understood that only one component of the force may be directed away from the center, and that some force may also be directed transverse to the outwardly-directed force.) The invention thus challenges the user's balance because it takes extra effort to remain on it.

In fact, the present invention promotes balance simply by standing on the device. Although the inventive aspects of the device are not dependant upon any particular theory of physics, physiology or exercise physiology, it is the inventor's understanding that the essence of balance may be to find a state of bodily organization from which the broadest range of movements are not only possible, but also involve the least amount of effort. Whether the activity is simply standing or skiing, a good sense of balance will tend to increase the user's ability to perform.

Figure 18:
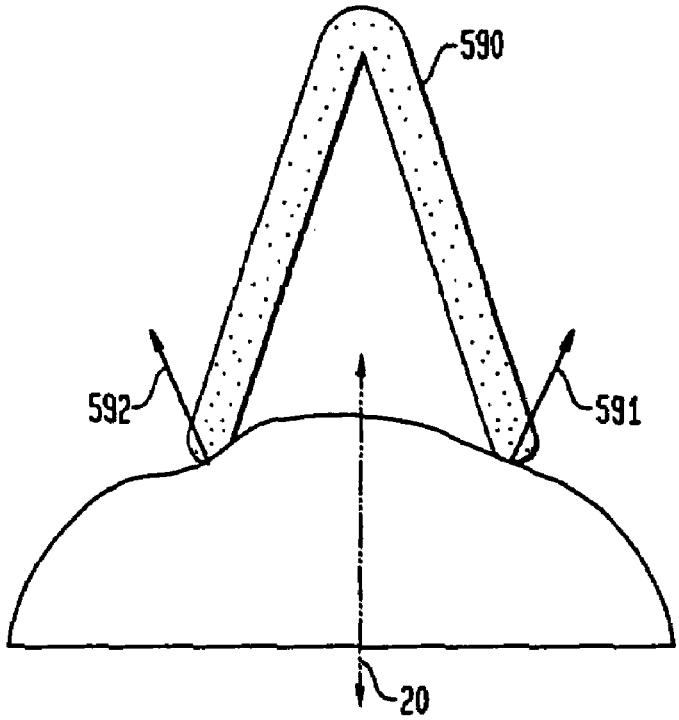
FIG. 18 is a schematic diagram of the forces exerted on another load by the device.

The present invention is believed to allow users to quickly achieve better balance. For example, FIG. 18 functionally illustrates the exercise of simply standing on the device. In order to maintain balance on the device with the least amount of effort, user 590 will have to adjust his stance and muscles so that the reactive forces 591 and 592 exerted on his feet—which forces independently tend to push the feet off the device—cancel one another out, thus allowing the user to stay on the device and come to quiet. When so standing on the device, many users may become aware of something that they may have ceased paying attention to, namely, that standing is highly complex and dynamic. For example, in practical use the device will exploit the body's slight movements. By using the device, it is believed that many users will intuitively begin to find the path of least resistance against gravity balance and, as a result, their body will begin to move and operate more efficiently.

The present invention also has the advantage of being able to accommodate a user's increasing skill. The pressure in the bladder can be quickly decreased simply by removing the plug or quickly increased with a hand pump. For many people, it will be much more difficult at low pressures than high pressures. Thus, even an experienced user can increase the challenge, and thus her skills, by decreasing the air pressure. Continuously decreasing the pressure over time also has another advantage: it provides visual and tactile feedback on the user's progress. If a user wishes, she may quantitatively measure her progress by measuring the diameter of the ring 55 closest to the center 51 of bladder 50 (FIG. 2) when the device is at rest. As air pressure is decreased, the bladder expands less and the diameter will decrease. Regardless, as shown in FIGS. 7A-7D of U.S. patent application Ser. No. 09/411,997, the inflation pressure and bladder dimensions should be such that a user will not cause the center top of the bladder to touch the base during use.

Moreover, in the event a user needs to get off the device due to a loss of balance, the present invention will tend to have a smaller vertical distance for the user to overcome than a typical trampoline. In a trampoline such as that shown in FIG. 17, the edges 463 must be higher than the center or at least accommodate a jumping person. Therefore, the edge of the trampoline tends to be a somewhat large distance above the floor. In the present invention, however, the outer edges are relatively close to the floor because they are below the center. Thus, in the event a user begins to lose his balance, he may find it easier to step off the present invention than a trampoline.

Moreover, despite the various forces exerted by the bladder against the user, the base tends to keep the entire unit in place and stable. The position of the device with the floor remains essentially constant.

The circular (when viewed from the top) shape of the present invention provides additional benefits. While the bladder may be elliptical or rectangular, a circular bladder tends to provide a set of forces in a predictable direction away from the center. Other shapes will not be as easily predictable. This not only adds a sense of consistency that the user can anticipate, but also helps prevent the user from finding a "sweet spot", i.e. a portion of the bladder whereby it is easier to stand on that section of the bladder due its shape.

Figure 19:
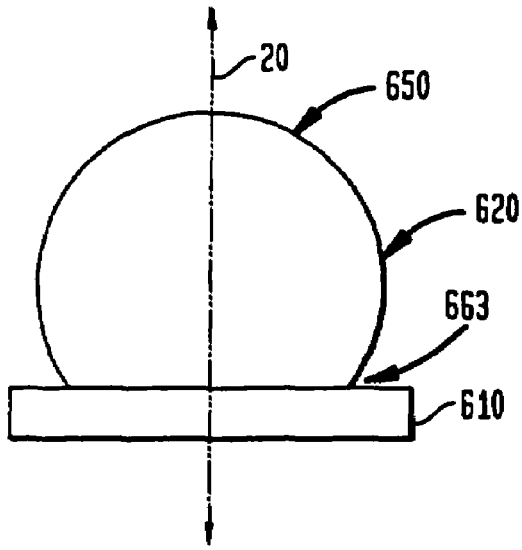
FIG. 19 is a side view of an over inflated device.

It is also preferable for the bladder top not to bulge over the base. When inflated, the widest part of the bladder should generally be the area where the bladder meets the base. FIG. 19 shows an over-inflated bladder 620 whereby the outermost edge 620 of the bladder extends well beyond the point 663 where the bladder is anchored to the base 610. If the radial distance between longitudinal axis 20 and the outermost edge 620 of the bladder 650 is significantly greater than the radial distance between longitudinal axis 20 and the anchor point 663, the device will tend to lose lateral stability. Moreover, the user may be raised higher above the base than necessary.

Unless stated to the contrary, use of the words such as "including," "containing," "comprising" and the like, means "including without limitation" and shall not be construed to limit any general statement that it follows to the specific or similar items or matters immediately following it.

Most of the foregoing alternative embodiments are not mutually exclusive, but may be implemented in various combinations to achieve unique advantages. As these and other variations and combinations of the features discussed above can be utilized without departing from the invention as defined by the claims, the foregoing description of the embodiments should be taken by way of illustration rather than by way of limitation of the invention as defined by the claims.

The invention claimed is:

1. A device for physical therapy, conditioning or training comprising:

a base structured and arranged for stable resting on the ground during use, the base having an uppermost surface and an inflatable flexible bladder having a top surface, a bottom surface, an outer edge portion where the top surface meets the bottom surface, and a downwardly-extending portion which extends from the outer edge portion and below the uppermost surface of the base, wherein the bladder is anchored to the base at the downwardly-extending portion.

2. The device of claim 1 wherein the base has a bottom surface, a wall extending between the uppermost and bottom surface of the base, and wherein the bladder is affixed to the base at the wall.

3. The device of claim 1 wherein the base defines a plane, and wherein the cross section of the bladder is substantially circular in a plane substantially parallel to the plane of the base.

4. The device of claim 1 wherein the base defines a plane, and wherein the cross section of the bladder is substantially elliptical in a plane substantially parallel to the plane of the base.

5. The device of claim 1 wherein the base defines a plane, and wherein the cross section of the bladder is substantially rectangular in a plane substantially parallel to the plane of the base.

6. The device of claim 1 wherein the bladder further comprises a bladder hole extending through the bottom surface of the bladder and connecting a chamber of the bladder to atmosphere.

7. The device of claim 6 further comprising a plug for closing the bladder hole.

8. The device of claim 7 wherein the plug is removable.

9. The device of claim 6 wherein the base further comprises a base hole extending from the bottom surface of the base, the base hole corresponding with the bladder hole so as to make the bladder hole accessible to a user of the device without removing the bladder from the base.

10. The device of claim 9 wherein the portion of the bottom surface of the bladder that corresponds with the bladder hole extends downwardly into the base hole.

11. The device of claim 1 wherein the inflatable flexible bladder is manufactured by a rotational molding process.

12. The device of claim 1 wherein the inflatable flexible bladder is composed of polyvinylchloride (PVC).

* * * * *

UNITED STATES PATENT AND TRADEMARK OFFICE

CERTIFICATE OF CORRECTION

PATENT NO. : 7,494,446 B2
APPLICATION NO. : 11/981878
DATED : February 24, 2009
INVENTOR(S) : David S. Weck and James E. Cotter It is certified that error appears in the above-identified patent and that said Letters Patent is hereby corrected as shown below:

Title Page, Item (73), Assignee: "San Diego, CA" should read --Wilmington, DE--

Signed and Sealed this
Twenty-fourth Day of July, 2012

David J. Kappos

David J. Kappos
*Director of the United States Patent and Trademark Office*